US012134968B2

(12) United States Patent
Jones et al.

(10) Patent No.: US 12,134,968 B2
(45) Date of Patent: Nov. 5, 2024

(54) INORGANIC SCALE DETECTION OR SCALING POTENTIAL DOWNHOLE

(71) Applicant: Halliburton Energy Services, Inc., Houston, TX (US)

(72) Inventors: Christopher Michael Jones, Houston, TX (US); James Martin Price, Houston, TX (US); Anthony Herman VanZuilekom, Houston, TX (US); Rohin Naveena-Chandran, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/946,140

(22) Filed: Sep. 16, 2022

(65) Prior Publication Data

US 2024/0093595 A1 Mar. 21, 2024

(51) Int. Cl.
*E21B 47/07* (2012.01)
*E21B 49/08* (2006.01)

(52) U.S. Cl.
CPC ..... *E21B 47/07* (2020.05); *E21B 49/081* (2013.01)

(58) Field of Classification Search
CPC .... E21B 49/081; E21B 49/082; E21B 49/083; E21B 49/087; E21B 49/0875; E21B 47/00; E21B 47/06; E21B 47/07
See application file for complete search history.

(56) References Cited

U.S. PATENT DOCUMENTS

| | | | | |
|---|---|---|---|---|
| 9,057,250 | B2 | 6/2015 | Zazovsky et al. | |
| 2005/0194134 | A1 | 9/2005 | McGregor et al. | |
| 2008/0066904 | A1 | 3/2008 | Van Hal et al. | |
| 2008/0125973 | A1 | 5/2008 | Sherwood et al. | |
| 2014/0196532 | A1* | 7/2014 | Bullock | E21B 49/08 73/152.24 |
| 2014/0338900 | A1* | 11/2014 | Jones | E21B 49/10 166/264 |
| 2015/0039230 | A1 | 2/2015 | Proett et al. | |
| 2016/0010455 | A1 | 1/2016 | Naveena-Chandran et al. | |
| 2016/0024915 | A1* | 1/2016 | Duchene | E21B 49/003 166/305.1 |
| 2016/0024916 | A1* | 1/2016 | de Oliveira | E21B 37/06 73/152.28 |

(Continued)

OTHER PUBLICATIONS

International Search Report and Written Opinion for International Patent Application No. PCT/US2022/045900 dated Jun. 7, 2023.

*Primary Examiner* — Christopher J Sebesta
(74) *Attorney, Agent, or Firm* — John Wustenberg; C. Tumey Law Group PLLC

(57) ABSTRACT

A method and system for identifying scale. The method may include disposing a fluid sampling tool into a wellbore. The fluid sampling tool may comprise at least one probe configured to fluidly connect the fluid sampling tool to a formation in the wellbore and at least one passageway that passes through the at least one probe and into the fluid sampling tool. The method may further comprise drawing a formation fluid, as a fluid sample, through the at least one probe and through the at least one passageway, perturbing the formation fluid, and analyzing the fluid sample in the fluid sampling tool for one or more indications of scale.

19 Claims, 7 Drawing Sheets

(56) References Cited

U.S. PATENT DOCUMENTS

| | | | | |
|---|---|---|---|---|
| 2016/0186546 | A1* | 6/2016 | Dawson | C09K 8/62 166/305.1 |
| 2018/0371904 | A1 | 12/2018 | Van Zuilekom et al. | |
| 2019/0017377 | A1 | 1/2019 | He et al. | |
| 2019/0100995 | A1 | 4/2019 | He et al. | |
| 2019/0162066 | A1 | 5/2019 | Chen et al. | |
| 2020/0240264 | A1 | 7/2020 | He et al. | |
| 2020/0284140 | A1 | 9/2020 | Jones et al. | |
| 2020/0362699 | A1* | 11/2020 | Zainalabedin | E21B 49/081 |
| 2020/0378250 | A1 | 12/2020 | Olapade et al. | |
| 2020/0400017 | A1 | 12/2020 | Olapade et al. | |
| 2020/0400858 | A1 | 12/2020 | Olapade et al. | |
| 2021/0047924 | A1 | 2/2021 | Kallehbasti et al. | |
| 2021/0054737 | A1* | 2/2021 | Dai | E21B 49/081 |
| 2021/0088447 | A1 | 3/2021 | Stark et al. | |
| 2021/0123313 | A1 | 4/2021 | Westacott et al. | |
| 2021/0123344 | A1 | 4/2021 | Westacott et al. | |
| 2021/0215033 | A1 | 7/2021 | Jones et al. | |
| 2021/0231001 | A1 | 7/2021 | Jones et al. | |
| 2021/0239000 | A1 | 8/2021 | Olapade et al. | |
| 2021/0332699 | A1 | 10/2021 | Dai et al. | |
| 2022/0235657 | A1 | 7/2022 | Golovko et al. | |
| 2022/0275724 | A1 | 9/2022 | Olapade et al. | |

* cited by examiner

INORGANIC SCALE DETECTION OR SCALING POTENTIAL DOWNHOLE

BACKGROUND

During oil and gas exploration, many types of information may be collected and analyzed. The information may be used to determine the quantity and quality of hydrocarbons in a reservoir and to develop or modify strategies for hydrocarbon production. For instance, the information may be used for reservoir evaluation, flow assurance, reservoir stimulation, facility enhancement, production enhancement strategies, and reserve estimation.

One technique for collecting relevant information involves obtaining and analyzing fluid samples from a reservoir of interest. There are a variety of different tools that may be used to obtain the fluid sample. The fluid sample may then be analyzed to determine fluid properties, including, without limitation, component concentrations, plus fraction molecular weight, gas-oil ratios, bubble point, dew point, phase envelope, viscosity, combinations thereof, or the like. Conventional analysis has required transfer of the fluid samples to a laboratory for analysis. Downhole analysis of the fluid sample may also be used to provide real-time fluid properties, thus augmenting laboratory measurements and also providing information mitigating delays associated with laboratory analysis. In addition, downhole fluid analysis may be acquired at more physical locations along the wellbore than may be sampled in the same amount of time. Further, downhole fluid analysis may improve or optimize the sampling operation.

Currently, fluid analysis may also take water samples. water sampling may be important for understanding water compatibility for enhanced oil recovery (EOR), fluid injection, or simply production of fluid from reservoirs. Water samples may be taken to a laboratory to determine is scale is present within the water samples. Scale may plug production equipment or damage the well in the near wellbore thereby destroying the economic capability of the well. Sampling water is normally not a priority in sampling operations and is analyses within a lab. Knowing if scaling from a zone may be in issue may help to determine if water sampling should be prioritized.

BRIEF DESCRIPTION OF THE DRAWINGS

These drawings illustrate certain aspects of some of the embodiments of the present disclosure, and should not be used to limit or define the disclosure.

DETAILED DESCRIPTION

Figure 1:
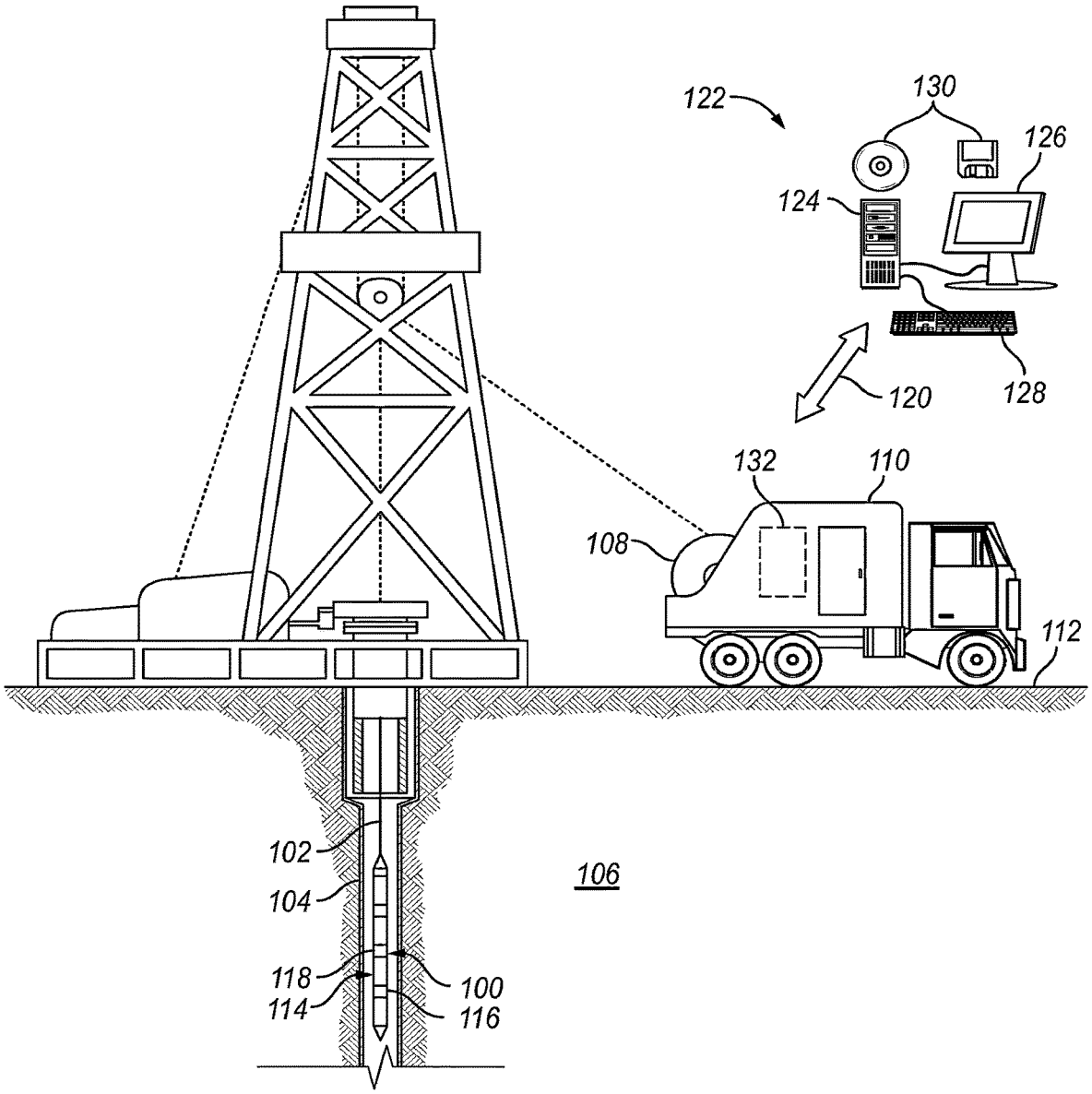
FIG. 1 is a schematic diagram of an example fluid sampling tool on a wireline.

Downhole sampling is a downhole operation that may be used for formation evaluation, asset decisions, and operational decisions. Generally, a fluid sampling tool is utilized for analyzing the fluids from a formation and their composition. Water sampling is often not a priority or performed. Additionally, if water sampling is performed, the water sample is analyzed at a lab at surface. Methods and systems discussed below may allow for water sampling to be performed downhole and detect scale, scaling effects, scaling potential, and scaling properties such as scaling kinetics downhole from the water sample.

For this disclosure, the systems and methods may capture and analyze fluids in a downhole environment. The multiphase nature of the fluids may be from aqueous formation fluid, aqueous drilling fluid filtrate, formation fluid gas, formation fluid oil, or oil-based filtrate. Filtrate is the liquid portion of a drilling fluid. These components may be present in combinations that yield multi-phase. Further, some drilling fluids, such as emulsions, may contain both oil and aqueous components. Hence, in order to derive the influence of the filtrate, the aqueous portion and the organic portion may be known.

As disclosed herein, a property of a fluid refers to a chemical property, phase property, i.e., fluid (liquid aqueous, liquid organic, or gas), or solid phase in concentration or identification, or phase behavior. Examples of properties may include, compositional component concentrations, such as methane, ethane, propane, butane, and pentane; organic liquid components, such as a hexane plus (C6+) fraction or hydrocarbon components therein, saturates fraction, aromatics fraction, resins fraction, asphaltenes fraction; total acid number; pH, eH (activity of electrons), water composition, including cations such as sodium, potassium, calcium, magnesium and trace cations, anions such as chloride, bromide, sulfide, sulfate, carbonate, bicarbonate, other dissolved solids; organic acids and/or their conjugates; and other inorganic components such as carbon dioxide, hydrogen sulfide, nitrogen or water. Physical properties may include compressibility, density, thermal conductivity, heat capacity, viscosity; phase behavior including bubble point, gas to oil ratio, phase envelope for gas-liquid or solid-liquid, including asphaltenes or waxes; and compositional grading with depth. Properties may also include the interpretation of similarity or differences between different set fluids such as that reflected by reservoir or field architecture, and reservoir compartmentalization. Properties may be used therein to obtain reservoir or field architecture or reservoir compartmentalization, compositional grading, and may be used to interpreted processes leading to various compositional grading or other equilibrium or disequilibrium distributions of fluids and fluid properties. Properties shall therefore refer to the measured, calculated, and inferred properties obtained from sensor measurements and the properties derived from other therein such as but not limited to that by interpretation, such as equation of state interpretation.

For example, the methods and apparatus disclosed herein may identify the phases of each dominating fluid for each channel. The methods and apparatus disclosed herein may further identify pure phase channel observations versus mixed phase channel observations. Identifying the fluid type or fluid phase on a per channel basis may further benefit the estimation of fluid phase ratios or concentrations; the assessment of mud contamination; the construction of pure signature for the formation fluids; and the producible water cut of a zone, including, but not limited to, a transition zone in which both formation oil and formation water is simultaneously sampled.

A method of fluid identification may comprise clustering a plurality of channels to automatically classify an observed optical or non-optical spectrum into different fluid groups. The methods may also comprise fluid labeling of each of the fluid groups, wherein the fluid labeling may be guided by the observation of a deterministic or probabilistic sensor channel which responds characteristically to different phases such as density sensor channel observations. After completion of the fluid labeling step, a fluid ratio estimation and a fluid signature extraction may be determined. Essentially, fluid ratio estimation and fluid signature estimation may be determined or extracted by grouping such as but not limited to clustering and labeling fluids based on the characteristic channel observation such as but not limited to the density observation.

Conventional methods may depend on pre-processing of the observed channel responses such as but not limited to optical data responses, such as debiasing and normalization. By contrast, the grouping methods such as but not limited to clustering methods disclosed herein may depend on a distribution such as a statistical distribution, rather than exclusively an amplitude bias or scaling as in conventional methods. The grouping methods such as clustering methods disclosed herein present a more robust method for fluid identification. The fluid labeling method disclosed herein may improve fluid classification performance by sharing information between at least two paired channels of at least one sensor. Cross sensor channel paring is also possible. Moreover, the fluid labeling methods disclosed herein may improve the accuracy of channel pairs of low separability by importing guiding information such as observed density, capacitance, resistivity, and acoustic information.

During formation tester pump outs, reservoir fluids are often multi-phase flow including slug flow, dispersed flow and emulsion flow, which may present difficulties in measuring combinations of liquids (water and oil) and gases or in some cases solids as well. It may be desirable to measure the physical and chemical properties of the individual phases of the fluids. The reservoir fluid compositions and distributions provide information for field engineers to make decisions on field development. Accurate gas composition may also assist in decision making regarding the installation of expensive production facilities. By directly measuring the sensor responses such as light-absorption responses for optical sensors of compositions in fluid samples, for instance optical measurement may provide an approach for fluid identification, composition analysis, and physical and chemical properties analysis.

The fluid samples may be measured either in a laboratory environment or in a real time subsurface borehole. Downhole fluid samples need not be captured in a container for analysis. Hence, as disclosed herein, the subsurface sensor channel measurements will be embodied by optical spectroscopy channels and a density sensor channel, but the embodiment is not exclusive to these sensors or channels. Optical sensor channel analysis may provide real-time information fluids at the field subsurface pressure and temperature. Other sensors with at least one channel include resistivity sensors, capacitance sensors, acoustic sensors, chromatographic sensors, microfluidic sensors, phase behavior sensors including but not limited to compressibility sensors and bubble point sensors, electrochemical sensors, mass spectrometer or mass spectroscopy sensors. Additionally, in the field the reservoir compositional variations may be directly mapped with greater spatial resolution than may otherwise be available, based on the number of samples which may be acquired downhole and sent to a laboratory. An in-situ compositional analysis may be combined with a spatial mapping of compositional properties and may provide an improved basis for selecting the locations from which to sample fluids for laboratory analysis. Moreover, the sample quality, as it is being withdrawn from a reservoir, may be quantified in terms of aliquot representation of the formation fluid in the reservoir and contamination levels of drilling fluid filtrate.

In some embodiments, it should be noted that only limited sensor channels such as optical channels may be implemented in subsurface optical spectroscopy. For example, the optical spectra of fluid samples may be measured channel by channel dynamically. In other examples, multiple channels may be acquired simultaneously, but at different locations. In other examples, a viewing window of the channels may oscillate between phases or a combination of phases therein and may provide difficult temporal analysis of the fluid's physical and chemical behavior.

For example, the fluid's chemical behavior may include, but may not limited to, a petroleum composition comprising saturates, aromatics, resins, asphaltenes fractions, methane, ethane, propane, butane, pentane, hexane and higher components and individual or lumped higher hydrocarbon components (where lumping may be the composite analysis or reporting of two or more hydrocarbon components), inorganic component composition, including water, nitrogen, carbon dioxide, and hydrogen sulfide chemical potential, including, but not limited to, reactive capability acidic levels of individual components, i.e., organic acids, or as a whole, i.e., pH or total acid number (TAN), or for instance redox potential. These chemical properties may be directly probed optically, by optical analysis in combination with other measurement devices, which may include, but may not be limited to, density, bubble point, compressibility, acoustic, NMR, capacitance, dielectric spectroscopy, nuclear methods, x-ray methods, terahertz methods, and resistivity.

Alternatively, chemical properties may be interpreted based on physical, chemical, or empirical models as a secondary interpretation based on the directly probed chemical properties, which may include but may not be limited to the listed methods. For example, physical properties may include, but may not limited to, bubble point, compressibility, phase envelope, density, and viscosity, and may be measured directly by devices such as density sensors, viscometers, phase behavior experimentation, trapped volume devices, fractionation devices such as valved devices or membrane devices or derived by physical, chemical, or empirical models as a secondary interpretation based on directly probed physical properties. Physical properties may be measured or derived based, in part, on multiple measurements. As a non-limiting example for instance, phase behavior (or other physical properties), like compressibility or bubble point may be derived based on combinations of physical measurements and compositions as modeled by an equation of state (EOS) such as, but not limited to, as Peng Robertson or SRK cubic equation of state, a viral equation of state, or a PC-SAFT equation of state or an empirical machine learning model such as, but not limited to a neural network or a random forest model or a gradient boost method. Multiphase fluids provide difficulties for interpretation.

During a subsurface optical measurement, sampled formation fluids may be together with some single phase or multiphase mud contaminations, flow through the sampling path. Alternatively, multiphase fluids may flow through the sampling path directly from multiphase formation fluids. Alternatively, multiphase fluids may be induced from phase changes due to pressure, volume, or temperature perturbations during sampling. In some examples, the sampled fluids for different channels may be distributed in space or time, such as channels configured in a rotating wheel positioned in an optical path of a fluid phase detector. However, as disclosed herein, the fluids may be sampled temporally by using a rotating wheel, wherein the fluids may be assumed to be the same phase (single-phase assumption). Consequently, obtaining the pure signature for the formation fluids and the mud filtrate may prove problematic, yielding errors for water/hydrocarbon ratio estimation and mud contamination assessment.

The present disclosure provides methods and apparatus for identifying the phases of dominating fluid for each channel, and further for identifying pure phase channel observations versus mixed phase channel observations. Identifying the fluid type on a per channel basis may further benefit the following: a) the estimation of fluid phase ratios or concentrations; b) the assessment of mud contamination; c) the construction of pure signature for the formation fluids; d) the producible water cut of a zone, including but not limited to, a transition zone; and e) the measurement of fluid properties for at least one of the inherent sample phases (oil, water, gas, solid).

FIG. 1 is a schematic diagram of fluid sampling tool 100 on a conveyance 102. As illustrated, wellbore 104 may extend through subterranean formation 106. In examples, reservoir fluid may be contaminated with well fluid (e.g., drilling fluid) from wellbore 104. As described herein, the fluid sample may be analyzed to determine fluid contamination and other fluid properties of the reservoir fluid. As illustrated, a wellbore 104 may extend through subterranean formation 106. While the wellbore 104 is shown extending generally vertically into the subterranean formation 106, the principles described herein are also applicable to wellbores that extend at an angle through the subterranean formation 106, such as horizontal and slanted wellbores. For example, although FIG. 1 shows a vertical or low inclination angle well, high inclination angle or horizontal placement of the well and equipment is also possible. It should further be noted that while FIG. 1 generally depicts a land-based operation, those skilled in the art will readily recognize that the principles described herein are equally applicable to subsea operations that employ floating or sea-based platforms and rigs, without departing from the scope of the disclosure.

As illustrated, a hoist 108 may be used to run fluid sampling tool 100 into wellbore 104. Hoist 108 may be disposed on a vehicle 110. Hoist 108 may be used, for example, to raise and lower conveyance 102 in wellbore 104. While hoist 108 is shown on vehicle 110, it should be understood that conveyance 102 may alternatively be disposed from a hoist 108 that is installed at surface 112 instead of being located on vehicle 110. Fluid sampling tool 100 may be suspended in wellbore 104 on conveyance 102. Other conveyance types may be used for conveying fluid sampling tool 100 into wellbore 104, including coiled tubing and wired drill pipe, conventional drill pipe for example. Fluid sampling tool 100 may comprise a tool body 114, which may be elongated as shown on FIG. 1. Tool body 114 may be any suitable material, including without limitation titanium, stainless steel, alloys, plastic, combinations thereof, and the like. Fluid sampling tool 100 may further include one or more sensors 116 for measuring properties of the fluid sample, reservoir fluid, wellbore 104, subterranean formation 106, or the like. In examples, fluid sampling tool 100 may also include a fluid analysis module 118, which may be operable to process information regarding fluid sample, as described below. The fluid sampling tool 100 may be used to collect fluid samples from subterranean formation 106 and may obtain and separately store different fluid samples from subterranean formation 106.

In examples, fluid analysis module 118 may comprise at least one a sensor that may continuously monitor a reservoir fluid. Such sensors include optical sensors, acoustic sensors, electromagnetic sensors, conductivity sensors, resistivity sensors, a capacitance sensor, selective electrodes, density sensors, mass sensors, thermal sensors, chromatography sensors, viscosity sensors, bubble point sensors, fluid compressibility sensors, flow rate sensors. Sensors may measure a contrast between drilling fluid filtrate properties and formation fluid properties. Fluid analysis module 118 may be operable to derive properties and characterize the fluid sample. By way of example, fluid analysis module 118 may measure absorption, transmittance, or reflectance spectra and translate such measurements into component concentrations of the fluid sample, which may be lumped component concentrations, as described above. The fluid analysis module 118 may also measure gas-to-oil ratio, fluid composition, water cut, live fluid density, live fluid viscosity, formation pressure, and formation temperature. Fluid analysis module 118 may also be operable to determine fluid contamination of the fluid sample and may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, fluid analysis module 118 may include random access memory (RAM), one or more processing units, such as a central processing unit (CPU), or hardware or software control logic, ROM, and/or other types of nonvolatile memory.

Any suitable technique may be used for transmitting phase signals from the fluid sampling tool 100 to the surface 112. As illustrated, a communication link 120 (which may be wired or wireless, for example) may be provided that may transmit data from fluid sampling tool 100 to an information handling system 122 at surface 112. Information handling system 122 may include a processing unit 124, a monitor 126, an input device 128 (e.g., keyboard, mouse, etc.), and/or computer media 130 (e.g., optical disks, magnetic disks) that can store code representative of the methods described herein. The information handling system 122 may act as a data acquisition system and possibly a data processing system that analyzes information from fluid sampling tool 100. For example, information handling system 122 may process the information from fluid sampling tool 100 for determination of fluid contamination. The information handling system 122 may also determine additional properties of the fluid sample (or reservoir fluid), such as component concentrations, pressure-volume-temperature properties (e.g., bubble point, phase envelop prediction, etc.) based on the fluid characterization. This processing may occur at surface 112 in real-time. Alternatively, the processing may occur downhole hole or at surface 112 or another location after recovery of fluid sampling tool 100 from wellbore 104. Alternatively, the processing may be performed by an information handling system in wellbore 104, such as fluid analysis module 118. The resultant fluid contamination and fluid properties may then be transmitted to surface 112, for example, in real-time.

Figure 2:
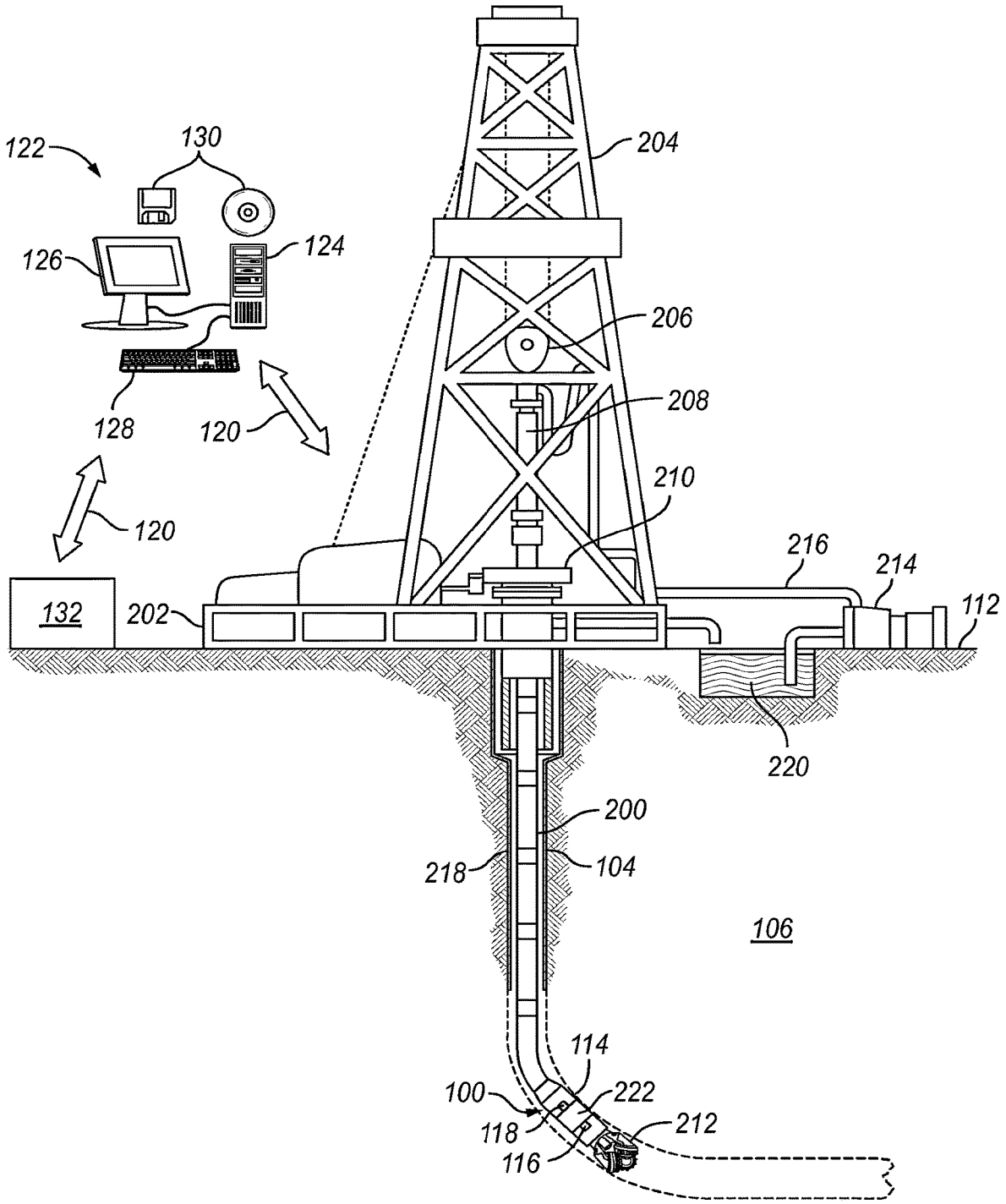
FIG. 2 is a schematic diagram of an example fluid sampling tool on a drill string.

Referring now to FIG. 2, a schematic diagram of fluid sampling tool 100 disposed on a drill string 200 in a drilling operation. Fluid sampling tool 100 may be used to obtain a fluid sample, for example, a fluid sample of a reservoir fluid from subterranean formation 106. The reservoir fluid may be contaminated with well fluid (e.g., drilling fluid) from wellbore 104. As described herein, the fluid sample may be analyzed to determine fluid contamination and other fluid properties of the reservoir fluid. As illustrated, a wellbore 104 may extend through subterranean formation 106. While the wellbore 104 is shown extending generally vertically into the subterranean formation 106, the principles described herein are also applicable to wellbores that extend at an angle through the subterranean formation 106, such as horizontal and slanted wellbores. For example, although FIG. 2 shows a vertical or low inclination angle well, high inclination angle or horizontal placement of the well and equipment is also possible. It should further be noted that while FIG. 2 generally depicts a land-based operation, those skilled in the art will readily recognize that the principles described herein are equally applicable to subsea operations that employ floating or sea-based platforms and rigs, without departing from the scope of the disclosure.

As illustrated, a drilling platform 202 may support a derrick 204 having a traveling block 206 for raising and lowering drill string 200. Drill string 200 may include, but is not limited to, drill pipe and coiled tubing, as generally known to those skilled in the art. A kelly 208 may support drill string 200 as it may be lowered through a rotary table 210. A drill bit 212 may be attached to the distal end of drill string 200 and may be driven either by a downhole motor and/or via rotation of drill string 200 from the surface 112. Without limitation, drill bit 212 may include, roller cone bits, PDC bits, natural diamond bits, any hole openers, reamers, coring bits, and the like. As drill bit 212 rotates, it may create and extend wellbore 104 that penetrates various subterranean formations 106. A pump 214 may circulate drilling fluid through a feed pipe 216 to kelly 208, downhole through interior of drill string 200, through orifices in drill bit 212, back to surface 112 via annulus 218 surrounding drill string 200, and into a retention pit 220.

Drill bit 212 may be just one piece of a downhole assembly that may include one or more drill collars 222 and fluid sampling tool 100. Fluid sampling tool 100, which may be built into the drill collars 222 may gather measurements and fluid samples as described herein. One or more of the drill collars 222 may form a tool body 114, which may be elongated as shown on FIG. 2. Tool body 114 may be any suitable material, including without limitation titanium, stainless steel, alloys, plastic, combinations thereof, and the like. Fluid sampling tool 100 may be similar in configuration and operation to fluid sampling tool 100 shown on FIG. 1 except that FIG. 2 shows fluid sampling tool 100 disposed on drill string 200. Alternatively, the sampling tool may be lowered into the wellbore after drilling operations on a wireline.

Fluid sampling tool 100 may further include one or more sensors 116 for measuring properties of the fluid sample reservoir fluid, wellbore 104, subterranean formation 106, or the like. The properties of the fluid are measured as the fluid passes from the formation through the tool and into either the wellbore or a sample container. As fluid is flushed in the near wellbore region by the mechanical pump, the fluid that passes through the tool generally reduces in drilling fluid filtrate content, and generally increases in formation fluid content. The fluid sampling tool 100 may be used to collect a fluid sample from subterranean formation 106 when the filtrate content has been determined to be sufficiently low. Sufficiently low depends on the purpose of sampling. For some laboratory testing below 10% drilling fluid contamination is sufficiently low, and for other testing below 1% drilling fluid filtrate contamination is sufficiently low. Sufficiently low also depends on the nature of the formation fluid such that lower thresholds may be utilized, the lighter the oil as designated with either a higher GOR or a higher API gravity. Sufficiently low also depends on the rate of cleanup in a cost benefit analysis since longer pumpout times utilized to incrementally reduce the contamination levels may have prohibitively large costs. As previously described, the fluid sample may comprise a reservoir fluid, which may be contaminated with a drilling fluid or drilling fluid filtrate. Fluid sampling tool 100 may obtain and separately store different fluid samples from subterranean formation 106 with fluid analysis module 118. Fluid analysis module 118 may operate and function in the same manner as described above. However, storing of the fluid samples in the fluid sampling tool 100 may be based on the determination of the fluid contamination. For example, if the fluid contamination exceeds a tolerance, then the fluid sample may not be desired to be stored. If the fluid contamination is within a tolerance, then the fluid sample may be stored in the fluid sampling tool 100.

As previously described, information from fluid sampling tool 100 may be transmitted to an information handling system 122, which may be located at surface 112. As illustrated, communication link 120 (which may be wired or wireless, for example) may be provided that may transmit data from fluid sampling tool 100 to an information handling system 111 at surface 112. Information handling system 140 may include a processing unit 124, a monitor 126, an input device 128 (e.g., keyboard, mouse, etc.), and/or computer media 130 (e.g., optical disks, magnetic disks) that may store code representative of the methods described herein. In addition to, or in place of processing at surface 112, processing may occur downhole (e.g., fluid analysis module 118). In examples, information handling system 122 may perform computations to estimate clean fluid composition.

Figure 3:
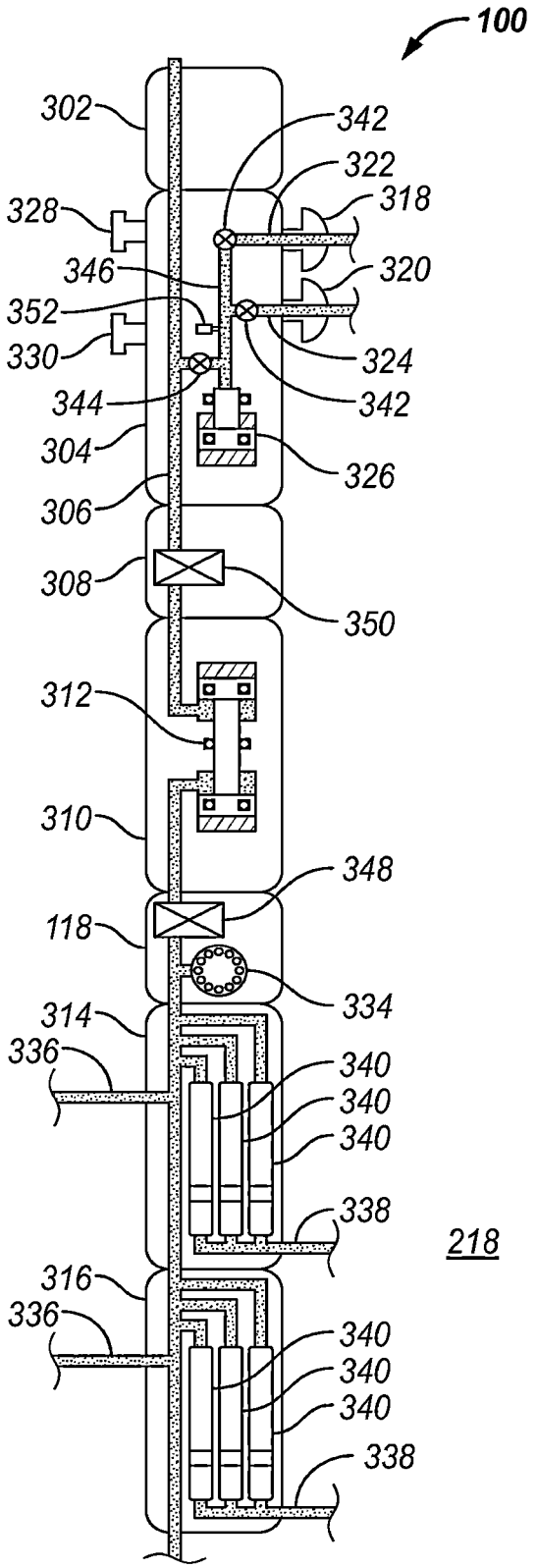
FIG. 3 is a schematic diagram of a fluid sampling tool with a filter disposed in a chamber.

FIG. 3 is a schematic of fluid sampling tool 100. In examples one embodiment, the fluid sampling tool 100 includes a power telemetry section 302 through which the tool communicates with other actuators and sensors 116 in drill string 200 or conveyance 102 (e.g., referring to FIGS. 1 and 2), the drill string's telemetry section 302, and/or directly with a surface telemetry system (not illustrated). In examples, power telemetry section 302 may also be a port through which the various actuators (e.g., valves) and sensors (e.g., temperature and pressure sensors) in the fluid sampling tool 100 may be controlled and monitored. In examples, power telemetry section 302 includes a computer that exercises the control and monitoring function. In one embodiment, the control and monitoring function is performed by a computer in another part of the drill string or wireline tool (not shown) or by information handling system 122 on surface 112 (e.g., referring to FIGS. 1 and 2).

In examples, fluid sampling tool 100 includes a dual probe section 304, which extracts fluid from the reservoir and delivers it to a passageway 306 that extends from one end of fluid sampling tool 100 to the other. Without limitation, dual probe section 304 includes two probes 318, 320 which may extend from fluid sampling tool 100 and press against the inner wall of wellbore 104 (e.g., referring to FIG. 1). Probe channels 322, 324 may connect probes 318, 320 to passageway 306. The high-volume bidirectional pump 312 may be used to pump fluids from the reservoir, through probe channels 322, 324 and to passageway 306. Alternatively, a low volume pump 326 may be used for this purpose. Two standoffs or stabilizers 328, 330 hold fluid sampling tool 100 in place as probes 318, 320 press against the wall of wellbore 104. In examples, probes 318, 320 and stabilizers 328, 330 may be retracted when fluid sampling tool 100 may be in motion and probes 318, 320 and stabilizers 328, 330 may be extended to sample the formation fluids at any suitable location in wellbore 104. Other probe sections include focused sampling probes, oval probes, or packers.

In examples, passageway 306 may be connected to other tools disposed on drill string 200 or conveyance 102 (e.g., referring to FIGS. 1 and 2). In examples, fluid sampling tool 100 may also include a quartz gauge section 308, which may include sensors to allow measurement of properties, such as temperature and pressure, of fluid in passageway 306. Additionally, fluid sampling tool 100 may include a flow-control pump-out section 310, which may include a high-volume bidirectional pump 312 for pumping fluid through passageway 306. In examples, fluid sampling tool 100 may include two multi-chamber sections 314, 316, referred to collectively as multi-chamber sections 314, 316 or individually as first multi-chamber section 314 and second multi-chamber section 316, respectively.

In examples, multi-chamber sections 314, 316 may be separated from flow-control pump-out section 310 by sensor section 332, which may house at least one non-optical fluid sensor 348 and/or at least optical measurement tool 334. It should be noted that non-optical fluid sensor 348 and optical measurement tool 334 may be disposed in any order on passageway 306. Additionally, although depicted in sensor section 332. Both non-optical fluid sensor 348 and optical measurement tool 334 may be disposed along passageway 306 at any suitable location within fluid sampling tool 100.

Non-optical fluid sensor 348 may be displaced within sensor section 332 in-line with passageway 306 to be a "flow through" sensor. In alternate examples, non-optical fluid sensor 348 may be connected to passageway 306 via an offshoot of passageway 306. Without limitation, optical measurement tool 334 may include but not limited to the density sensor, capacitance sensor, resistivity sensor, and/or combinations thereof. In examples, non-optical fluid sensor 348 may operate and/or function to measure fluid properties of drilling fluid filtrate.

Optical measurement tool 334 may be displaced within sensor section 332 in-line with passageway 306 to be a "flow through" sensor. In alternate examples, optical measurement tool 334 may be connected to passageway 306 via an offshoot of passageway 306. Without limitation, optical measurement tool 334 may include optical sensors, acoustic sensors, electromagnetic sensors, conductivity sensors, resistivity sensors, a capacitance sensor, selective electrodes, density sensors, mass sensors, thermal sensors, chromatography sensors, viscosity sensors, bubble point sensors, fluid compressibility sensors, flow rate sensors, microfluidic sensors, selective electrodes such as ion selective electrodes, and/or combinations thereof. In examples, optical measurement tool 334 may operate and/or function to measure drilling fluid filtrate, discussed further below.

Additionally, multi-chamber section 314, 316 may comprise access channel 336 and chamber access channel 338. Without limitation, access channel 336 and chamber access channel 338 may operate and function to either allow a solids-containing fluid (e.g., mud) disposed in wellbore 104 in or provide a path for removing fluid from fluid sampling tool 100 into wellbore 104. As illustrated, multi-chamber section 314, 316 may comprise a plurality of chambers 340. Chambers 340 may be sampling chamber that may be used to sample wellbore fluids, formation fluids, and/or the like during measurement operations.

During downhole measurement operations, a pumpout operation may be performed. A pumpout may be an operation where at least a portion of a fluid which may contain solids—(e.g., drilling fluid, mud, filtrate etc.) may move through fluid sampling tool 100 until substantially increasing concentrations of formation fluids enter fluid sampling tool 100. For example, during pumpout operations, probes 318, 320 may be pressed against the inner wall of wellbore 104 (e.g., referring to FIG. 1). Pressure may increase at probes 318, 320 due to compression against the formation 106 (e.g., referring to FIG. 1 or 2) exerting pressure on probes 318, 320. As pressure rises and reaches a predetermined pressure, valves 342 opens so as to close equalizer valve 344, thereby isolating fluid passageway 346 from the annulus 218. In this manner, valve 342 ensures that equalizer valve 344 closes only after probes 318, 320 has entered contact with mud cake (not illustrated) that is disposed against the inner wall of wellbore 104. In examples, as probes 318, 320 are pressed against the inner wall of wellbore 104, the pressure rises and closes the equalizer valve in fluid passageway 346, thereby isolating the fluid passageway 346 from the annulus 218. In this manner, the equalizer valve in fluid passageway 346 may close before probes 318, 320 may have entered contact with the mud cake that lines the inner wall of wellbore 104. Fluid passageway 346, now closed to annulus 218, is in fluid communication with low volume pump 326.

As low volume pump 326 is actuated, formation fluid may thus be drawn through probe channels 322, 324 and probes 318, 320. The movement of low volume pump 326 lowers the pressure in fluid passageway 346 to a pressure below the formation pressure, such that formation fluid is drawn through probe channels 322, 324 and probes 318, 320 and into fluid passageway 346. Probes 318, 320 serves as a seal to prevent annular fluids from entering fluid passageway 346. Such an operation as described may take place before, after, during or as part of a sampling operation.

Next, high-volume bidirectional pump 312 activates and equalizer valve 344 is opened. This allows for formation fluid to move toward high-volume bidirectional pump 312 through passageway 306. Formation fluid moves through passageway 306 to sensor section 332. Once the drilling fluid filtrate has moved into sensor section 332 high-volume bidirectional pump 312 may stop. This may allow the drilling fluid filtrate to be measured by optical measurement tool 334 within sensor section 332. Without limitation, any suitable properties of the formation fluid may be measured. Other pumps may be used such as centrifugal pumps, siphon pumps, or even underbalanced actuation of natural fluid flow such as but not limited to drill stem testing operations or underbalanced drilling operations, or managed pressure operations.

Figure 4:
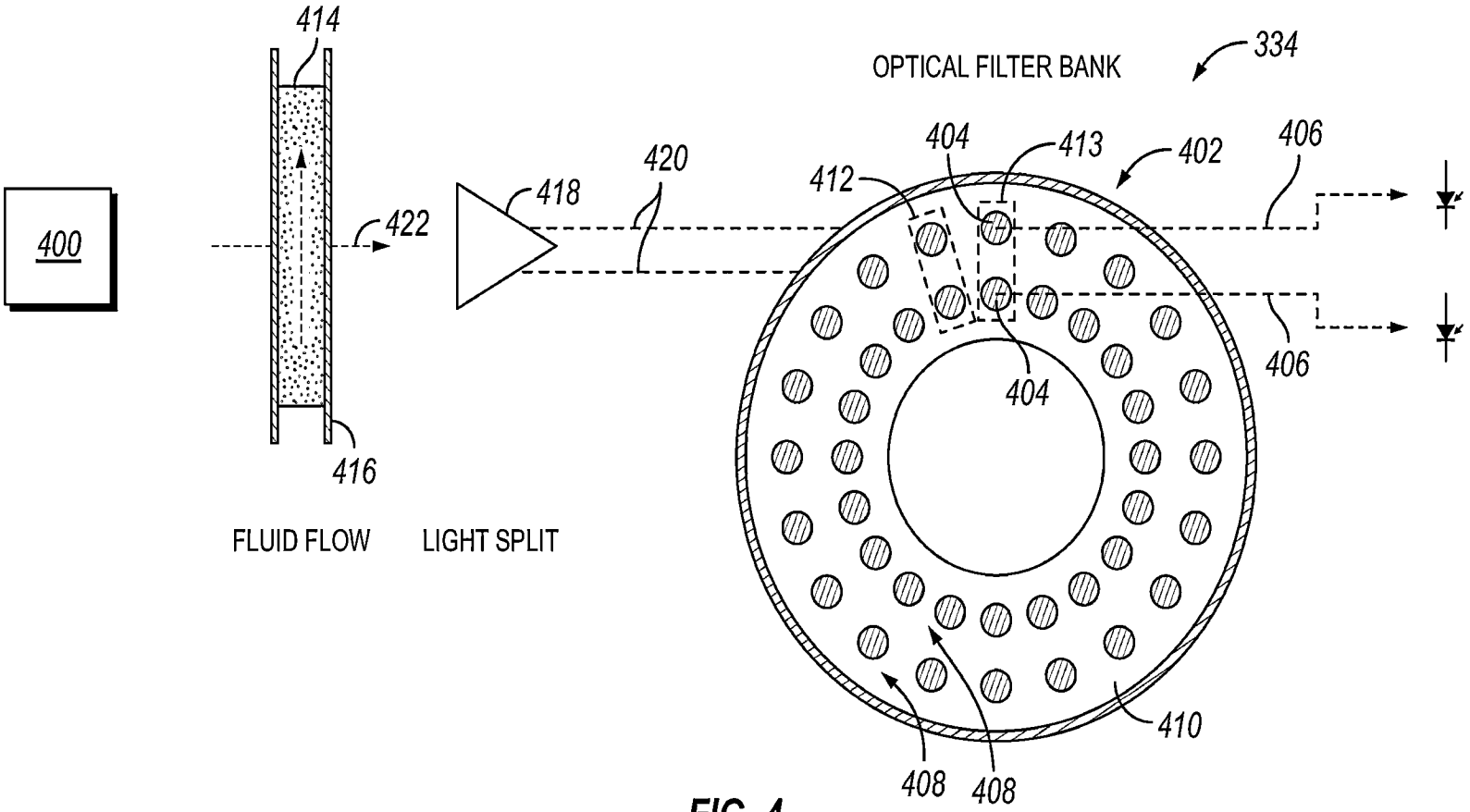
FIG. 4 depicts a hardware configuration of a dynamic subsurface optical measurement tool.

FIG. 4 depicts a hardware configuration of a dynamic subsurface optical measurement tool 334. It should be note that a channel, disclosed herein, may be a measurement of the light transmittance through an optical filter. Optical measurement tool 334 may include a light source 400, a filter bank 402 comprising a plurality of optical filters 404 (measurement of the light transmittance through an optical filter 404 is called a channel 406) configured as two rings 408 on optical plate 410, within a channel pair 412 on each azimuth. It should be noted that each channel 406 may be designed, based on the construction of each channel 406 respective optical filter 404, to measured different properties of fluid sample 414. During the rotation of optical plate 410, the two optical filters 404 on a channel pair 412 may be synchronized spatially or in time to measure substantially the same fluid sample 414 in viewing area 416, which may be a glass pipe. As discussed below, and illustrated in FIG. 4, an active channel pair 413 is a channel pair 412 in which optical measurements are being taken to form one or more channels 406. In some embodiments, channel pairs 412 may be near synchronized such that channel pairs 412 have a sufficient probability of observing the same phase, i.e., better than 10% but more desirably more than 50% and yet more desirably more than 80%. In other embodiments, more than two channels 406 may be sufficiently synchronized according to a desired probability of observing a single phase in time or space. A velocity calculation of the fluid phase specific velocities may be used to aid synchronization over longer distances, or time. Alternatively, distribution calculations, or autocorrelation calculations may be used to improve the synchronization over longer distances or time. If the channels are sufficiently close in distance or time, the channel signals may not need additional efforts of synchronization. During measurement operations, fluid samples 414 (which is formation fluid from passageway 306) may flow through a viewing region as a non-limiting example constructed by a set of windows or other transparent region of the flow path. Alternatively, the viewing region or viewing area might not be transparent to visible light but rather to the form of energy used to measure the fluid characteristics for a given sensor. As such a viewing region or area for an acoustic sensor would ideally have a low acoustic impedance even if it is not transparent to visible light. Alternatively, the viewing region or area may be transparent (i.e., pass energy with low attenuation) to infrared light, or magnetic fields instead of visible light. In some embodiments for some sensors, the viewing area 416 or area is more generally a measurement region or area as is the case with some phase behavior sensors or some density sensors. In examples, viewing area 416 may be at least a part of passageway 306 and/or a branch off of passageway 306). In one nonlimiting embodiment, light 422 absorbed by fluid sample 414 may be split into at least two ray paths 420, through a prism 418. Split light rays 420 may be measured by detectors, not shown, as they pass through channel pair 412 separately. Filter bank 402 may rotate to another channel pair 412 after the measurement of each channel 406 from channel pair 412 and may dynamically gather an optical spectra measurement of all channels after a full sampling channel rotation. It should be noted, the methods disclosed herein may not be limited in simultaneous measurements of a channel pair 412 (two optical filters 404 and their respective channel 406) but may also apply to cases with one or more optical filters 404 or filter banks 402, at least one channel 406, or, alternatively, two or more channels 406. Optical measurement tool 334 may not only be utilized for identifying properties of fluid samples 414 but also be utilized for detecting scaling effects, scaling potential, and scaling properties such as scaling kinetics downhole.

Figure 5:
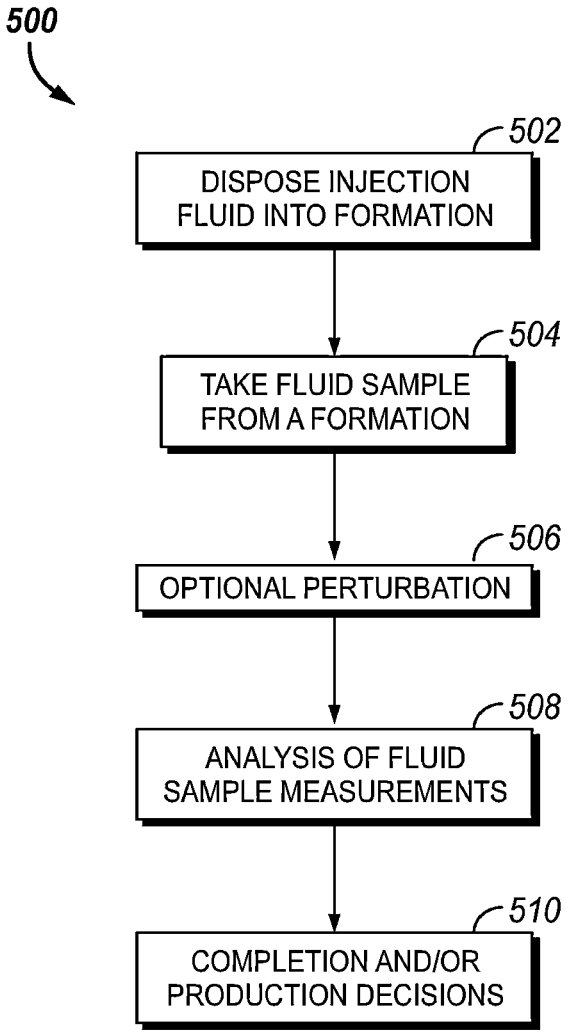
FIG. 5 is a workflow for the detection of scale precipitation in situ downhole using the fluid sampling tool.

FIG. 5 illustrates a workflow 500 for the detection of scale precipitation in situ downhole using fluid sampling tool 100 (e.g., referring to FIG. 1), during measurement operations (i.e., pumpout). Workflow 500 may begin with block 502 in which an injection fluid may be disposed into formation 106. The injection fluid may be disposed into formation 106 from fluid sampling tool 100. In examples, during operations, a selected amount of formation fluid may be withdrawn and sample, an injection fluid may be injected into formation 106 from fluid sampling tool 100, at which time, more formation fluid may be removed and sampled by fluid sampling tool 100. This procedure and/or method may be performed by a mechanical pump within fluid sampling tool 100, which operates, and functions as described above.

Additionally, injection fluid may be injected using "mud" in which the injection fluid is disposed into the mud at surface 112 (e.g., referring to FIG. 1). The mud is circulated within wellbore 104 and penetrates formation 106 at any depth of wellbore 104 (e.g., referring to FIG. 1). Additionally, the injection fluid may be disposed at a predetermined zone within wellbore 104. This may be performed by injecting the injection fluid between one or more packers through a pipe string, coiled tubing, and/or the like. The injection fluid may be utilized to bring about the formation of scale through chemical perturbation.

As noted above, chemical perturbation may be achieved by mixing the injection fluid with formation fluids from formation 106. The mixing may take place within fluid sampling tool 100, within formation 106 near fluid sampling tool 100, and/or any combination therein. A perturbation is achieved by invading formation 106 or wellbore region near fluid sampling tool 100 with the injection fluid. The injection fluid may be a high pH fluid (caustic above pH 8). The injection fluid may be tailored to detect multiple scale types. The injection fluid may be a sulfate or carbonate variant. For example, iron sulfate, iron carbonate, magnesium sulfate, magnesium carbonate, barium sulfate, barium carbonate, and/or the like. The injection fluid may be carried within fluid sampling tool 100, a secondary formation tester, coiled tubing operation, or mixed into the drilling fluid system.

In block 504, a fluid sample from formation 106 is taken, using the methods and systems described above. In examples, the fluid sample may be drawn through one or more probes 318, 320 (e.g., referring to FIG. 3). It should be noted that probes 318, 320 are for illustration purposes only. There may be many different configurations for probes 318, 320. For example, probes 318 may be disposed on an oval or a circular pad. Still further, one of the probes 318, 320 may be a guard probe and encircle the other probe 318, 320. In any example, the fluid sample may be drawn through at least one of the one or more probes 318, which may be in any suitable configuration.

In examples, the fluid sample may be drawn into fluid sampling tool 100 through a probe 318, 320 that is a guard probe. This may allow for the identification that any precipitation observed was due to mixing of the fluid sample using a perturbation method and not due to temperature or pressure changes. In the example, probe 318, 320 that is not the guard probe may withdraw a fluid sample that has less to no injection fluid and the guard probe may withdraw a fluid sample with a large mix of injected fluid from formation 106 (e.g., referring to FIG. 1). This allows a comparison of a low to zero perturbation fluid with a higher concentration perturbation fluid with respect to the formation fluid.

In block 506, an optional perturbation may be performed on the fluid sample within formation sampling tool 100. For example, the fluid sample may be perturbed by changing at least one of temperature, pressure, or chemical composition of the fluid sample. In examples, the fluid sample may be perturbed using a heat source, a cold source, applying a pressure, applying electricity, and/or applying acoustic waves to the sample source. For example, to change at least one of temperature or chemical composition of the fluid sample, a heat source may be applied. In examples, the heat source may be an electric heating, chemical heating, or eutectic cooling may be applied to the fluid sample at sensor 350 (e.g., referring to FIG. 3). In other examples, the heat source or eutectic cooling may be applied directly to probes 318, 320 or combined to a single probe line in order to directly monitor the effect of a temperature perturbation. Pressure perturbation may be achieved on the inlet or outlet of pump 326 (e.g., referring to FIG. 3) by choking the entrance or exit (i.e., through probes 318, 320 and equalizer valve 344) of fluid sampling tool 100 (or directional flow line therein). Pressure may be measured by pressure sensor 352 (e.g., referring to FIG. 3), which may be connected to the entrance or exit lines. Additionally, the electrical perturbation may be applied, for example, by having the fluid flow path confined between two electrodes and a voltage applied. Further, acoustic perturbation may be applied, for example, with a transducer communicatively coupled to the flow path. Fluid sampling tool 100 may record temperature, pressure physical properties and chemical properties of the fluid sample upon perturbation using information handling system 122 (e.g., referring to FIG. 1).

A kinetic model may be formed by knowing the ratio of the injection fluid to formation fluid in the fluid sample (i.e., relative concentration percentage of injection fluid to formation fluid), any perturbation effects on the fluid sample, as well as the relative concentration of the scale (as determined by the turbidity, which is total intensity blockage), or rate of formation as determined by the derivative therein which may be resistant to settling effects. The kinetic model for the perception event may be formed which may further identify scale within wellbore 104 (e.g., referring to FIG. 1). For example, a kinetic model may be applied with known temperature, pressure and flow rate, to fit the rate of precipitation and further characterize the precipitate based off that rate. One precipitate kinetic model would yield a kinetic rate for the observed sensor data as a function of time, whereas a different precipitate would have a different rate curve. If, however, the kinetic model for a particular event is not known or needs to be refined for the downhole environment, (such as the fact that many interferent ions will affect the rate of scaling) then the kinetic effects may be measured directly. Other non-optical fluid sensor 348 (e.g., referring to FIG. 3) may provide useful information regarding scaling detection or scaling potential or scaling characteristics, include water sensors including optical or electrode, chromatography sensors including ion chromatography, liquid chromatography, and mass spectroscopy sensors.

Figure 6:
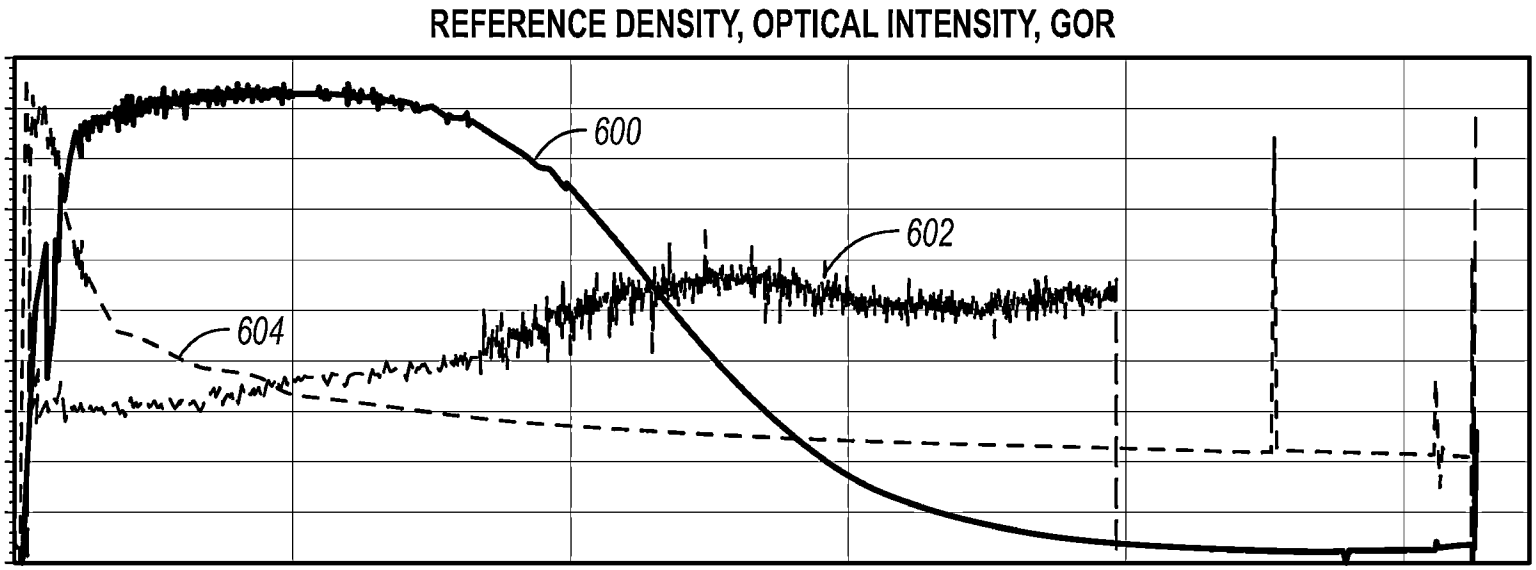
FIG. 6 is a graph illustrating optical throughput, fluid density, and a composition measurement of a fluid sample from a measurement operation.
Figure 7:
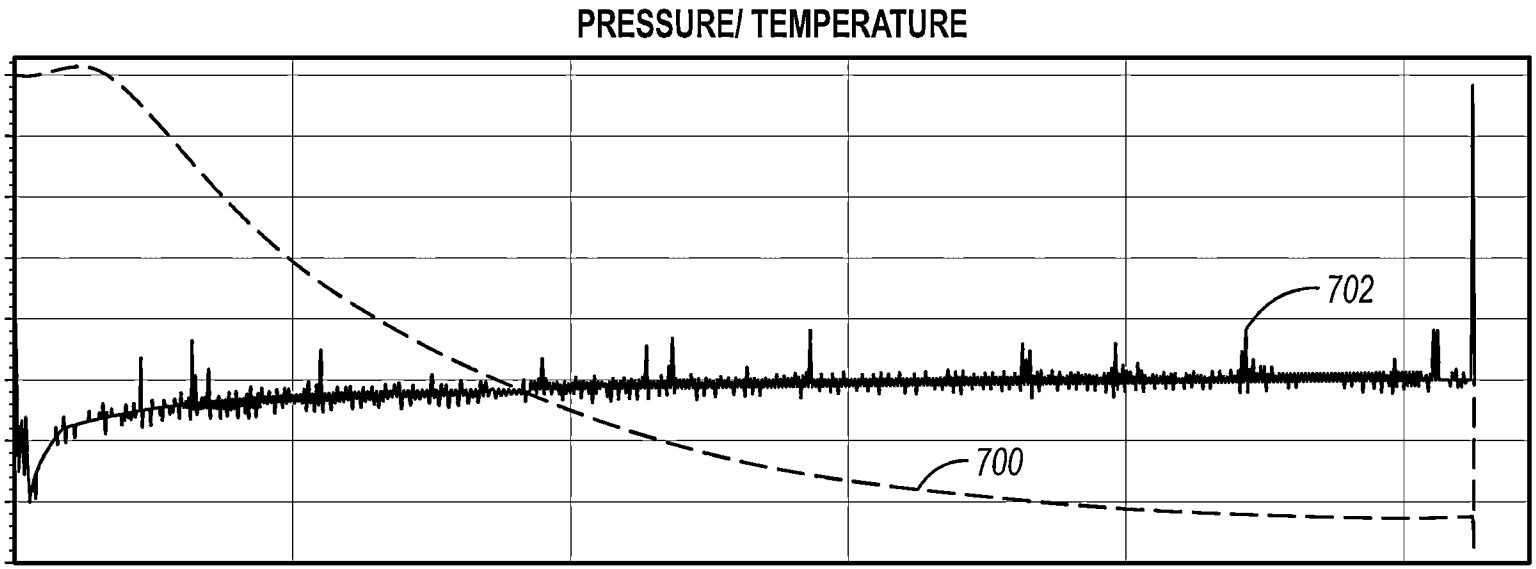
FIG. 7 is a graph illustrating temperature and pressure measurements from the measurement operation.

In block 508, analysis of fluid sample measurements is performed to identify scale buildup. In examples, indications of scale may be found from analysis of temperature, optical throughput, pressure measurements, and/or change of chemical composition of the fluid sample. In examples, change of chemical composition may be identified by asphaltene precipitation and/or increase in C6+ hydrocarbon compositions. FIGS. 6 and 7 are graphs plotting fluid sample measurements taken during measurement operations. FIG. 6 is a graph illustrating density, optical intensity, and gas-oil-ratio vs time. FIG. 7 is graph illustrating temperature and pressure vs time. Black line 600 is the total optical throughput of the fluid sample, orange line 700 is the temperature of the fluid sample, purple line 602 is a composition measurement by optical means, green line 604 is the fluid density, and blue line 702 is pressure. The X axis is time. FIG. 7 illustrates that temperature (orange line 700) starts to reduce, which is unusual as temperature within fluid sampling tool 100 does not normally reduce within wellbore 104 (e.g., referring to FIG. 1) during measurement operations. Additionally, the optical intensity (black line 600) also decreases. Generally, during measurement operations (i.e., pumpout operations) optical intensity usually fluctuates or transitions but not smoothly to a zero intensity (without rebounding quickly).

Reasons that the optical intensity may decrease include the fluid sample being darker than the filtrate, or the optical path becoming blocked. For FIGS. 6 and 7, the density values, which may be measured utilizing the sensors described above, denote a light fluid and therefore probably transparent. Thus, the optical path becoming blocked is the more likely explanation. In examples, solid particles and emulsion may be two reasons that the optical path may become blocked aside from a malfunction of optical measurement tool 334 (e.g., referring to FIG. 3). However, sensors within optical measurement tool 334 are generally not prone to malfunction, thus a sensor malfunction is unlikely the expiation and the observation is likely a real fluid effect. Additionally, this real fluid effect is likely not an emulsion because the nature of the light oil is not one to form emulsions. Therefore, the likely explanation is particles. Although not illustrated, sensor malfunction may be ruled out by taking a gas-to-oil (GOR) measurement. If noise is present, it is indicative of particles. These measurements may be taken in non-optical fluid sensor 348 (e.g., referring to FIG. 3) or other area of fluid sampling tool 100.

Other factors shown in FIGS. 6 and 7 that may be considered are that when the flow of the fluid sample is stopped at the end of the pumpout, the signal becomes more transparent which is indicative of particles settling which is further evidence of particles. Particles may come from formation 106, from a bad seal in which the particles of mud are let into the tool. Bad seals usually have sharp darkening events followed by quick cleanup (with the potential of repeats). However, as illustrated in FIGS. 6 and 7, a smooth decrease in intensity is observed. Asphaltene precipitation may also be ruled out as an improbably since there is not a pressure trigger event is seen in the pressure measurements (blue line 702), and higher pressure typically provides a greater stability for asphaltenes. Additionally, the temperature (orange line 700) does not significantly reduce upon asphaltene precipitation. Precipitation of scale and more specifically calcium carbonate scale is an endothermic reaction that consumes heat and may lower the temperature of the system. In this manner, carbonate scale is a likely explanation of the effect.

Referring back to FIG. 5, in block 510, a completion decision and production decision may be made in view of the presence or no presence of scale in wellbore 104 (e.g., referring to FIG. 1).

Improvements over the current art is found in the identification of scale. For example, the current art requires captured samples to be back calculated for composition in order to determine scaling effects. The precipitants may be affected by bringing a sample to surface and be affected by a level of contamination. The methods and systems described above moves to mitigate these effects by identifying scale downhole utilizing an injection fluid.

Statement 1: A method may include disposing a fluid sampling tool into a wellbore. The fluid sampling tool may comprise at least one probe to fluidly connect the fluid sampling tool to a formation in the wellbore and at least one passageway that passes through the at least one probe and into the fluid sampling tool. The method may further comprise drawing a formation fluid, as a fluid sample, through the at least one probe and through the at least one passageway, perturbing the formation fluid, and analyzing the fluid sample in the fluid sampling tool for one or more indications of scale.

Statement 2: The method of statement 1, wherein perturbing the formation fluid is performed with a heat source.

Statement 3: The method of statement 2, wherein the heat source is an electrical heat source or a chemical heat source.

Statement 4: The method of statements 1 or 2, wherein perturbing the formation fluid is performed with an eutectic cooling source.

Statement 5: The method of any preceding statements 1, 2, or 4, wherein perturbing the formation fluid is performed by applying a pressure to the fluid sample.

Statement 6. The method of any preceding statements 1, 2, 4, or 5, wherein perturbing the formation fluid is performed by applying electricity to the fluid sample.

Statement 7: The method of any preceding statements 1, 2, or 4-6, wherein perturbing the formation fluid is performed by applying an acoustic wave to the fluid sample.

Statement 8: The method of any preceding statements 1, 2, or 4-7, further comprising introducing an injection fluid into the formation fluid.

Statement 9. The method of statement 8, wherein the injection fluid is selected from a group include an iron sulfate, an iron carbonate, a magnesium sulfate, a magnesium carbonate, a barium sulfate, and a barium carbonate.

Statement 10: The method of statement 8, wherein the introducing the injection fluid into the formation fluid is performed by injecting the injection fluid into the formation using the fluid sampling tool.

Statement 11: The method of statement 8, wherein the introducing the injection fluid into the formation fluid is performed by injecting the injection fluid into the formation using a mud that is circulated through the wellbore.

Statement 12: The method of statement 8, wherein the introducing the injection fluid into the formation fluid performed by injecting the injection fluid into the formation through a pipe string in a zone defined by at least two packers.

Statement 13: The method of statement 12, wherein the pipe string is coiled tubing.

Statement 14: The method of statement 12, wherein the pipe string is a drill string.

Statement 15: The method of any preceding statements 1, 2, or 4-8, wherein analyzing the fluid sample in the fluid sampling tool for one or more indications of scale is performed from a group comprising an optical sensor, an acoustic sensor, an electromagnetic sensor, a conductivity sensor, a resistivity sensor, a capacitance sensor, a selective electrode, a density sensor, a mass sensor, a thermal sensor, a chromatography sensor, a viscosity sensor, a bubble point sensor, a fluid compressibility sensor, or a flow rate sensor.

Statement 16: The method of any preceding statements 1, 2, 4-8, or 15, wherein the one or more indications of scale are identified by a temperature drop.

Statement 17: The method of any preceding statements 1, 2, 4-8, 15, or 16, wherein the one or more indications of scale are identified by a reduction in an optical throughput.

Statement 18: The method of any preceding statements 1, 2, 4-8, or 15-17, wherein the one or more indications of scale are identified by a stabilized pressure measurement.

Statement 19: The method of any preceding statements 1, 2, 4-8, or 15-18, wherein the one or more indications of scale are identified by a change in a chemical composition of the formation fluid.

Statement 20: The method of any preceding statements 1, 2, 4-8, or 15-19, further comprising identifying the one or more indications of scale using a kinetic model.

The preceding description provides various embodiments of systems and methods of use which may contain different method steps and alternative combinations of components. It should be understood that, although individual embodiments may be discussed herein, the present disclosure covers all combinations of the disclosed embodiments, including, without limitation, the different component combinations, method step combinations, and properties of the system.

Statement 1 [Claims Bank Added after Approval of Claims]

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

Therefore, the present embodiments are well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Although individual embodiments are discussed, the disclosure covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

What is claimed is:

1. A method comprising:

disposing a fluid sampling tool into a wellbore wherein the fluid sampling tool comprises:

at least one probe to fluidly connect the fluid sampling tool to a formation in the wellbore; and at least one passageway that passes through the at least one probe and into the fluid sampling tool;

drawing a formation fluid, as a fluid sample, through the at least one probe and through the at least one passageway;

isolating the drawn formation fluid in the at least one passageway from an annulus;

perturbing the formation fluid within a sensor section, wherein the sensor section is in fluid communication with the at least one passageway within the fluid sampling tool, wherein perturbing the formation fluid is performed by cooling the formation fluid with a eutectic cooling source or by using a heat source; and analyzing the fluid sample in the fluid sampling tool for one or more indications of inorganic scale in a water sample.

2. The method of claim 1, wherein the heat source is an electrical heat source or a chemical heat source.

3. The method of claim 1, wherein perturbing the formation fluid is performed by applying a pressure to the fluid sample.

4. The method of claim 1, wherein perturbing the formation fluid is performed by applying electricity to the fluid sample.

5. The method of claim 1, wherein perturbing the formation fluid is performed by applying an acoustic wave to the fluid sample.

6. The method of claim 1, wherein the introducing the injection fluid into the formation fluid is performed by injecting the injection fluid into the formation using the fluid sampling tool.

7. The method of claim 1, further introducing an injection fluid into the formation fluid is performed by injecting the injection fluid into the formation using a mud that is circulated through the wellbore.

8. The method of claim 1, further introducing an injection fluid into the formation fluid is performed by injecting the injection fluid into the formation through a pipe string in a zone defined by at least two packers.

9. The method of claim 8, wherein the pipe string is coiled tubing.

10. The method of claim 8, wherein the pipe string is a drill string.

11. The method of claim 1, wherein analyzing the fluid sample in the fluid sampling tool for one or more indications of inorganic scale is performed from a group comprising:

an optical sensor, an acoustic sensor, an electromagnetic sensor, a conductivity sensor, a resistivity sensor, a capacitance sensor, a selective electrode, a density sensor, a mass sensor, a thermal sensor, a chromatography sensor, a viscosity sensor, a bubble point sensor, a fluid compressibility sensor, or a flow rate sensor.

12. The method of claim 1, wherein the one or more indications of inorganic scale are identified by a temperature drop.

13. The method of claim 1, wherein the one or more indications of inorganic scale are identified by a reduction in an optical throughput.

14. The method of claim 1, wherein the one or more indications of inorganic scale are identified by a stabilized pressure measurement.

15. The method of claim 1, wherein the one or more indications of inorganic scale are identified by a change in a chemical composition of the formation fluid.

16. A method comprising:

disposing a fluid sampling tool into a wellbore wherein the fluid sampling tool comprises:

at least one probe to fluidly connect the fluid sampling tool to a formation in the wellbore; and at least one passageway that passes through the at least one probe and into the fluid sampling tool;

drawing a formation fluid, as a fluid sample, through the at least one probe and through the at least one passageway;

isolating the drawn formation fluid in the at least one passageway from an annulus;

then perturbing the formation fluid to induce at least one phase change due to at least one volume change within a sensor section to detect scale, scaling effects, scaling potential, scaling properties, or any combination thereof, wherein the sensor section is in fluid communication with the at least one passageway within the fluid sampling tool; and analyzing the fluid sample in the fluid sampling tool for one or more indications of inorganic scale.

17. The method of claim 16, wherein perturbing the formation fluid is performed by changing at least one of temperature or pressure of the fluid sample inside the fluid sampling tool.

18. The method of claim 16, wherein analyzing the fluid sample in the fluid sampling tool for one or more indications of scale is performed by using a dual measurement from at least two different sensors selected from a group of sensors consisting of an optical sensor, an electromagnetic sensor, a conductivity sensor, a resistivity sensor, a capacitance sensor, a selective electrode, a density sensor, a mass sensor, a chromatography sensor, a viscosity sensor, a bubble point sensor, or a fluid compressibility sensor.

19. A method comprising:

disposing a fluid sampling tool into a wellbore wherein the fluid sampling tool comprises:

at least one probe to fluidly connect the fluid sampling tool to a formation in the wellbore; and at least one passageway that passes through the at least one probe and into the fluid sampling tool;

drawing a formation fluid, as a fluid sample, through the at least one probe and through the at least one passageway;

perturbing the formation fluid by introducing an injection fluid into the formation fluid, wherein the injection fluid is selected from a group comprising an iron sulfate, an iron carbonate, a magnesium sulfate, a magnesium carbonate, a barium sulfate, and a barium carbonate;

analyzing the fluid sample in the fluid sampling tool for one or more indications of inorganic scale in a water sample; and identifying the one or more indications of inorganic scale using a kinetic model formed by knowing the ratio of the injection fluid to formation fluid in the fluid sample, how the perturbing of the fluid is performed, and a relative concentration of the inorganic scales in the water sample.

* * * * *